US011779048B2

(12) United States Patent
Cieslikowski et al.

(10) Patent No.: US 11,779,048 B2
(45) Date of Patent: Oct. 10, 2023

(54) METHOD AND APPARATUS FOR MANUFACTURING OF RODS

(71) Applicant: International Tobacco Machinery Poland Sp. z o. o., Radom (PL)

(72) Inventors: Bartosz Cieslikowski, Radom (PL); Radoslaw Figarski, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 0 days.

(21) Appl. No.: 17/302,765

(22) Filed: May 12, 2021

(65) Prior Publication Data

US 2021/0378288 A1 Dec. 9, 2021

(30) Foreign Application Priority Data

Jun. 3, 2020 (EP) ..... 20178076

(51) Int. Cl.

| | |
|---|---|
| ***A24D 3/02*** | (2006.01) |
| ***A24C 5/34*** | (2006.01) |
| ***A24D 3/06*** | (2006.01) |
| *A24D 3/10* | (2006.01) |

(52) U.S. Cl.

CPC ..... *A24D 3/0275* (2013.01); *A24C 5/34* (2013.01); *A24D 3/0233* (2013.01); *A24D 3/0254* (2013.01); *A24D 3/061* (2013.01); *A24D 3/10* (2013.01)

(58) Field of Classification Search

CPC .. A24D 3/0208; A24D 3/0254; A24D 3/0233; A24D 3/061; A24D 3/0275; A24D 3/0216; A24D 3/10; A24C 5/34; A24C 5/01; A24C 5/1828

See application file for complete search history.

(56) References Cited

U.S. PATENT DOCUMENTS

2007/0068540 A1* 3/2007 Thomas ..... A24D 3/0229 131/88

2020/0107571 A1 4/2020 Sanna

FOREIGN PATENT DOCUMENTS

| | | | |
|---|---|---|---|
| EP | 2636322 | B1 | 9/2013 |
| EP | 2762016 | A2 | 8/2014 |
| EP | 2822409 | A1 | 1/2015 |
| WO | WO2011024105 | A1 | 3/2011 |
| WO | WO2013132434 | A1 | 9/2013 |

* cited by examiner

*Primary Examiner* — Thomas M Wittenschlaeger

(74) *Attorney, Agent, or Firm* — Oppedahl Patent Law Firm LLC

(57) ABSTRACT

An apparatus for manufacturing of rods of a continuous material strand comprising a feeding unit for feeding material strand, a guiding unit for guiding material strand, a compressing unit for compressing the strand and forming a continuous rod of the material strand, and an object feeding unit for feeding an object to the compressing unit. The apparatus is characterised by being provided with a cutting unit for lengthwise cutting of the material strand into at least two partial strands, whereas the partial strands are fed through the guiding unit to the compressing unit. It is provided with a system for adjusting the position of at least one cutting element in the cutting unit so as to adjust the widths of the partial strands thus determining the point of insertion of the object being inserted.

6 Claims, 14 Drawing Sheets

METHOD AND APPARATUS FOR MANUFACTURING OF RODS

The object of an invention is a method and an apparatus for manufacturing of rods of a continuous material strand.

A solution concerns machines for manufacturing of rods of a continuous material strand used in the tobacco industry wherein during forming of a continuous rod, objects of special properties, for example beads with aromatic substances, are placed between the fibres of the strand. Such objects have to be placed in a specific positions relative to both an axis of the rods and the ends of the rods, otherwise a rod is classified as defective and rejected, which results in production losses.

BACKGROUND

Apparatuses for inserting individual objects in continuous material strands are known in the prior art. The publication WO2011024105A1 disclosed a machine for manufacturing of rods of an acetate strand into which beads with an aromatic substance are placed, whereas the beads are put into the acetate strand by means of a feeding wheel whose edge is inserted with the beads between compressed fibres of the strand.

A similar solution was disclosed in the document EP2636322B1. In both disclosed solutions, in the partially compressed material strand a groove is made into which the beads are inserted, whereas when making the groove some of the fibres are crushed and some other fibres are pushed aside. A drawback of these solutions is that the crushed fibres after decompression may cause a change in the position of the bead due to the fact that the force coming from the crushed fibres in the direction opposite to the direction of bead insertion, in this case upwards, is greater than in the other directions.

The rod-like articles of the tobacco industry are often provided with beads, plates or other objects which are inserted into the inside of the continuous rod and fulfil respective technological functions in finished tobacco products.

In the document US 20200107571, there was disclosed an apparatus for forming a continuous rod using two independent material strands which are compressed around a centrally inserted metal tape. The apparatus according to US 20200107571 compresses the strands around the metal tape by means of a forming funnel of a known structure.

In the prior art, an identified problem is to gain control of the position of the bead or another object inserted into the inside of the material strand forming the continuous rod. A typical solution is to adjust the position of the feeding wheel depending on intended position of the inserted bead.

Currently known methods for forming a continuous rod containing the objects do not allow an online adjustment in the course of the production. There is a need for a solution which will allow an adjustment without stopping the machine so as to keep the repeatability of the position transversely to the axis, namely in the vertical and horizontal direction.

The problem to be solved by this invention is to make it possible to adjust the position of the object (the bead, the plate) in the course of the production, without the need of stopping the machine, and at the same time to ensure the repeatability of the position of the object in the strand of fibres in both vertical and horizontal direction.

SUMMARY OF THE INVENTION

According to the invention, an apparatus and a method for adjusting the position of the bead are based on the adjustment of elements surrounding the bead in the material bundle being formed and in the formed continuous rod by means of adaptive forming of the bundle strands so as to adjust the position of a pocket in which the object is inserted inside the continuous rod. A new method for adjusting the position of the object is introduced, replacing or complementing the known method consisting in an adjustment of the position of the inserting wheel.

The object of the invention is an apparatus for the manufacturing of rods of a continuous material strand comprising a feeding unit for feeding material strand, a guiding unit for guiding the material strand, a compressing unit for compressing the strand and forming a continuous rod of the material strand, and an object feeding unit for feeding an object to the compressing unit. The apparatus is characterised by being provided with a cutting unit for lengthwise cutting of the material strand into at least two partial strands, whereas the partial strands are fed through the guiding unit to the compressing unit. The apparatus is further characterised by being provided with an adjustment system for adjusting the position of at least one cutting element in the cutting unit so as to adjust the width of the partial strands thus determining the point of insertion of the object being inserted.

Preferably the apparatus is characterised in that in the compressing unit, at least over a part of the length of the compressing unit, there is situated at least one separating element to separate at least two partial strands.

Preferably, the apparatus is characterised in that in the guiding unit there is situated at least one separating element for separating at least two partial strands.

Preferably, the apparatus is characterised in that the separating element in the guiding unit and/or in the compressing unit is attached so that it may be angularly or linearly adjusted.

Preferably, the apparatus is characterised in that the separating element is attached by means of a spring-like element.

Preferably, the apparatus is characterised in that the object feeding unit is adapted to feed the individual objects into the region of the compressing unit by means of a feeding wheel provided with pockets for the objects.

Preferably, the apparatus is characterised in that the object feeding unit is adapted to feed the continuous object into the range of the compressing unit by means of the feeding wheel provided with a guiding groove.

Preferably, the apparatus is characterised in that the cutting unit is provided with at least one pair of knives.

Preferably, the apparatus is characterised by being provided with at least one sensor for checking the position of the object placed inside the continuous rod, transversely to the axis of the continuous rod, whereas the system for adjusting the position of at least one knife in the cutting unit is adapted to adjust the widths of the partial strands depending on the signal from the said at least one sensor so as to obtain the position of the object nearest to the axis of the continuous rod.

Preferably, the apparatus is characterised in that the sensor is adapted to check the position of the object in the cross-section of the continuous rod in the vertical or horizontal direction.

Preferably, the apparatus is characterised in that the cutting unit is adapted to lengthwise cutting of the material strand into at least three partial strands so as to determine the position of the object being inserted.

Preferably, the apparatus is characterised in that the cutting unit is adapted to adjust the position of the cutting elements independently of other elements.

Preferably, the apparatus is characterised in that the feeding unit designed to feed the material strand is adapted to feed the material selected from a group comprising: acetate fibres, crimped paper, crimped tobacco foil.

The object of the invention is also a method for the manufacturing of rods of the continuous material strand wherein the material strand is fed, the material strand is cut lengthwise into at least two partial strands, the cut partial strands are put together and the put together partial strands are prepared for the compression, the partial strands are compressed by forming the continuous rod of the lengthwise cut partial strands and an object is inserted into the inside of the continuous rod between the partial strands. The method is characterised in that the position of the object inserted inside the continuous rod transversely to the axis of the continuous rod is checked, and the position of at least one cutting element in the cutting unit is adjusted so as to alter the widths of the partial strands.

Preferably, the method is characterised in that the position of the object is checked by means of a sensor, and the position of at least one cutting element in the cutting unit is adjusted depending on the signal from the sensor.

The presented solution ensures an increase in efficiency of a production machine. The solution provides the possibility of shaping a separating line between partial material strands of which the continuous rod is formed. Due to the balance of forces acting on the inserted object and exerted by the surrounding strands, a central position of the object with a greater repeatability was achieved.

An advantage of the solution is providing the adjustment of the position of the point of object insertion in the continuous rod without the need of altering the position of the inserting unit. The use of the geometry of the strands being put together and forming the continuous rod allows determining the object insertion point in the space by appropriately selecting the strand widths, so already at the stage of cutting the material strand into individual partial strands.

Furthermore, an advantage of the solution is the limitation of forces acting on the object being inserted, due to inserting the object at the separating line of the strands or at the junction of several strands forming the continuous rod. It limits the occurrence of forces pushing the object out which occur in the prior art when using a plough separating connected fibres, e.g. compressed acetate or crimped paper strand. It results from the fact that unlike in known solutions of the prior art, in the disclosed invention there is no need of forming/opening a gap in the interconnected fibres of the strand forming the continuous rod, however, there is the need of maintaining a boundary between unconnected strands between which the object will be inserted. The separation of the partial strands makes the object inserting easier and protects against their uncontrolled movement.

Furthermore, an advantage of the invention is the possibility of correcting the position of an object inside a product which despite a planned position inside the product has not been placed in the designed position as a result of the action of technological factors. The proposed invention gives flexible possibilities of determining the position of the object being inserted with the use of measuring and heuristic techniques.

DESCRIPTION OF THE DRAWING

The object of the invention is shown in detail in a preferred embodiment in a drawing in which.

DETAILED DESCRIPTION

Figure 1:
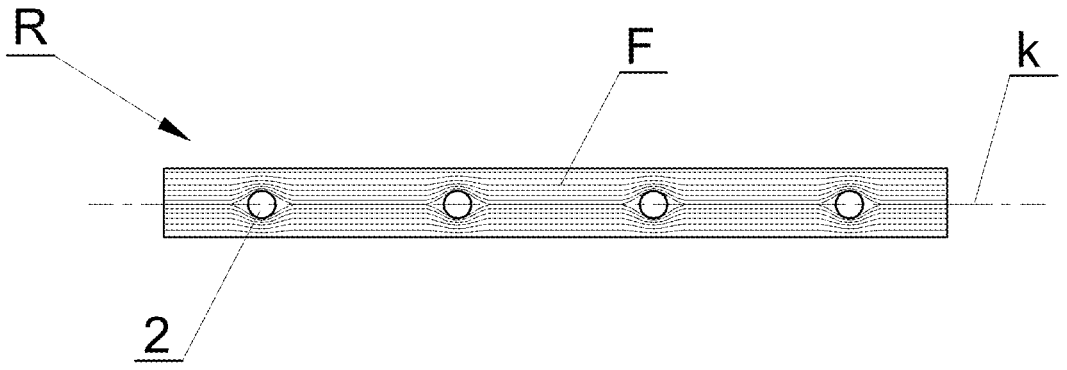
FIG. 1 shows a cross-section through a filter rod R containing four beads.

An exemplary filter rod R shown in the cross-section in FIG. 1 comprises four objects in the form of beads 2 situated within fibres F of a filter material. The beads 2 are disposed along the axis k of the filter rod R and centrally to the axis k.

Figure 2:
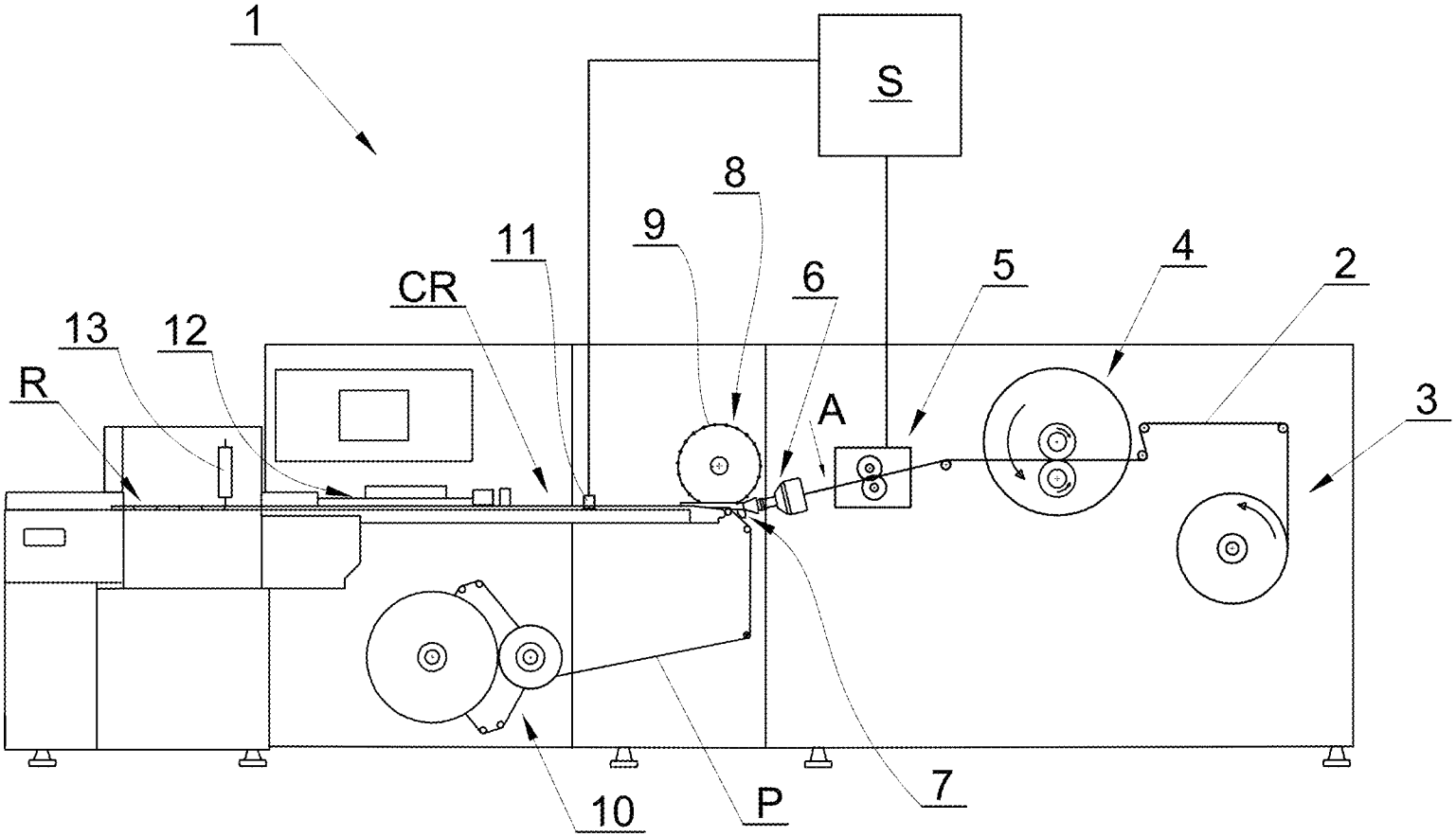
FIG. 2 shows an apparatus for the manufacturing of rods of a continuous material strand in the first embodiment.

FIG. 2 shows an apparatus 1 for manufacturing of the rods R of a continuous material strand 2 in the first embodiment. The material strand 2 comprises acetate fibres, alternatively the material strand is made of tobacco, cellulose foil, paper or fibres having filtering properties, in both smooth and crimped form. In the manufacturing process, within the material strand 2 there are placed such objects as beads, tubes, tape sections etc. which after forming a continuous rod CR will be situated inside such continuous rod, and after cutting such continuous rod they will be situated inside the individual rods R. The apparatus 1 comprises a feeding unit 3 for feeding material strand 2, a crimping unit 4 for lengthwise crimping of the material strand 2, a cutting unit 5 for lengthwise cutting of the material strand 2 into at least two partial strands, preferably into three partial strands a, b, c, a guiding unit 6 for guiding the cut partial strands a, b, c and feeding the partial strands for the compression, a compressing unit 7 for compressing the strand and forming the continuous rod CR of the lengthwise cut partial strands a, b, c. Before the cutting unit 5 or before the guiding unit 6, there is situated a unit (not shown in the drawing) for changing a flat configuration of the material strand to a wavy configuration, i.e. such configuration in which in a cross-section the material strand or the partial strands have a wavy shape. The wavy shape of the partial strands makes the material compression easier. The apparatus 1 further comprises a feeding unit 8 for feeding the object 9 and inserting the object 9 into the inside of the continuous rod CR being formed. The formed continuous rod CR is wrapped with a band of a wrapping material P fed by the feeding unit 10 for feeding wrapping material P. The apparatus 1 shown in FIG. 2 is provided with a sensor 11 situated next to the path of movement of the continuous rod CR, designed to check the position of the object 9 in the continuous rod CR transversely to the axis k of such continuous rod, in both vertical and horizontal axis of the cross-section of the continuous rod CR formed in such way. The sensor 11 is a sensor operating on the basis of electromagnetic radiation in the range of visible, invisible, X-ray or microwave radiation. The apparatus 1 is provided with a forming unit 12 for final forming and lengthwise sealing of the continuous rod CR. The guiding unit 6, the compressing unit 7 and the forming unit 12 constitute together a forming apparatus designed to form the continuous rod CR. The apparatus 1 is provided with a rotational cutting head 13 by means of which the continuous rod CR is cut into the individual rods R.

Figure 3:
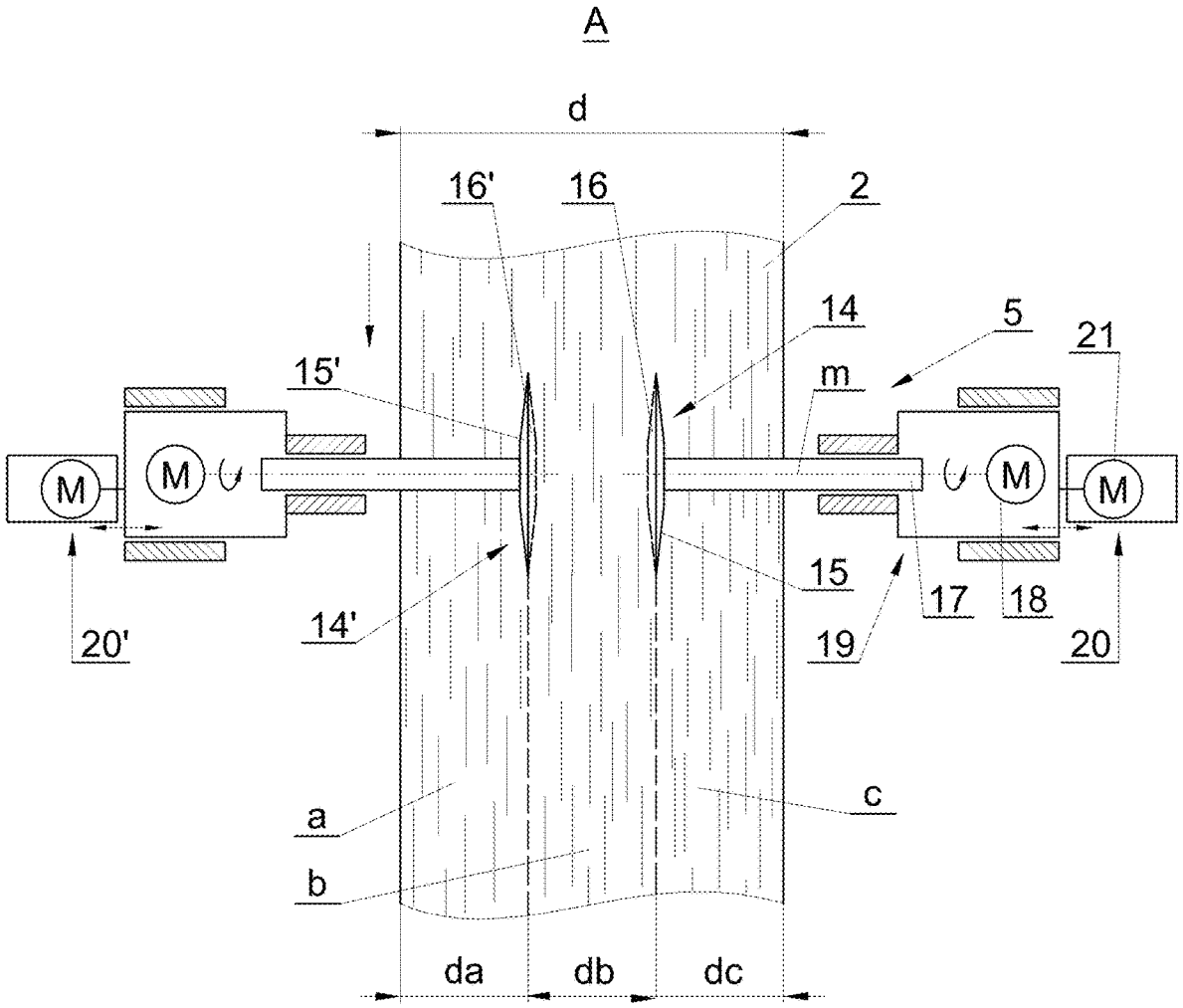
FIGS. 3 and 4 show a top view of a crimped material strand cut into partial strands by a cutting unit.
Figure 13:
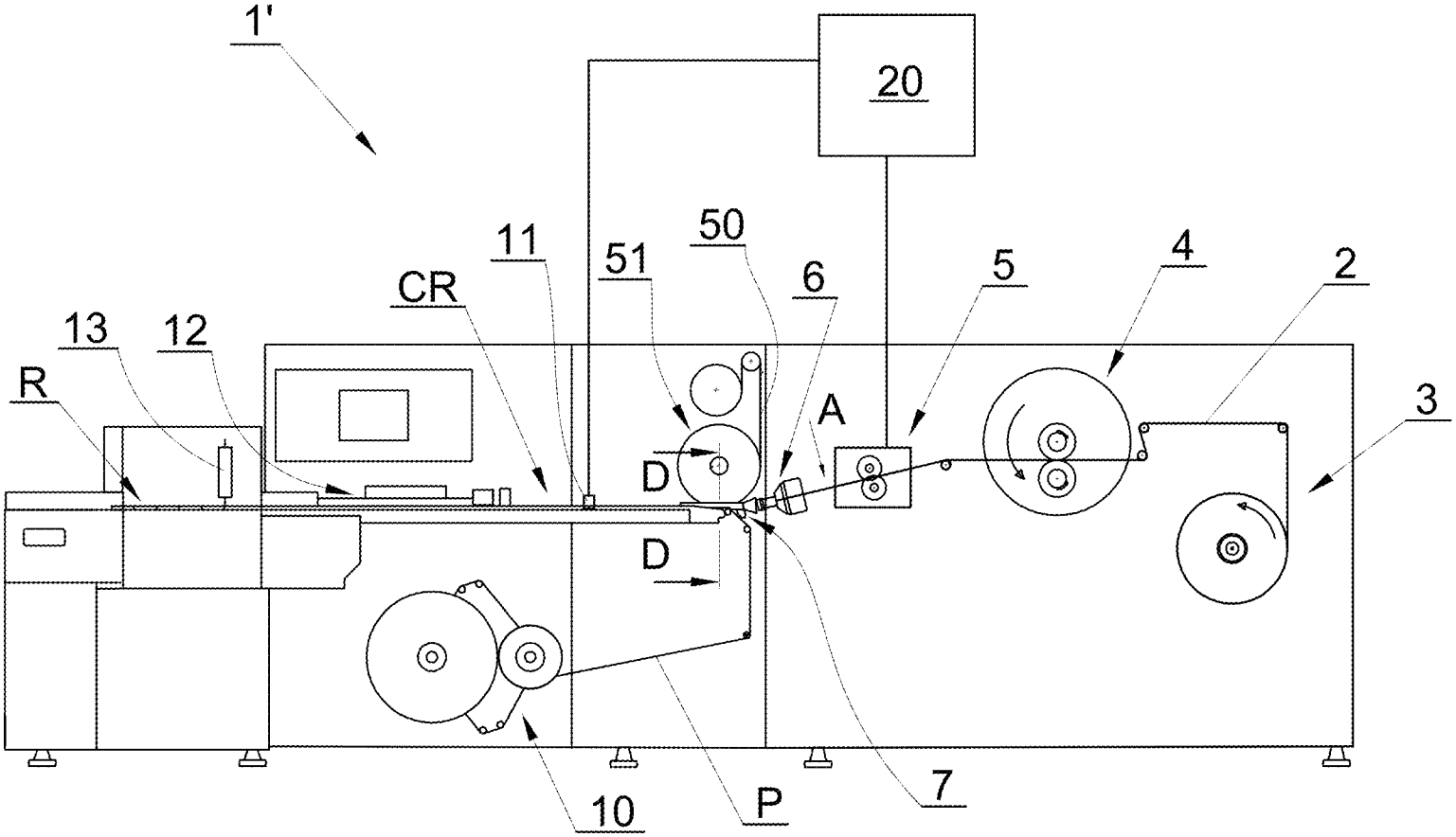
FIG. 13 shows an apparatus for the manufacturing of rods of the continuous material strand in the second embodiment.
Figure 22:
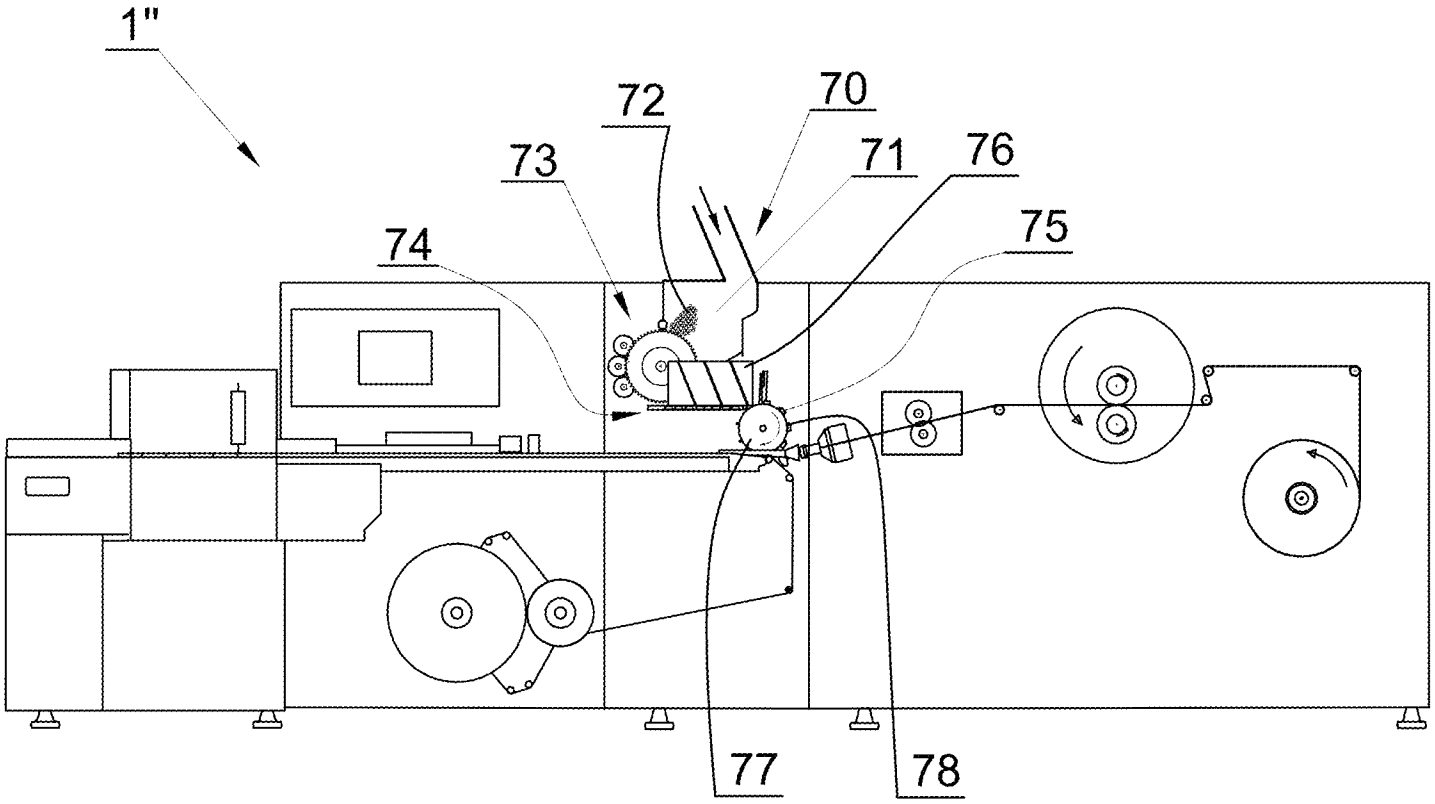
FIG. 22 shows the apparatus for the manufacturing of rods of the continuous material strand in the third embodiment.

FIG. 3 shows a top view A of a strand of crimped material 2 which is cut lengthwise into partial strands a, b, c by the cutting unit 5. The cutting unit 5 is provided with at least one pair 14 of rotatably mounted circular knives 15, 16. The pair 14 of knives comprises an upper circular knife 15 situated above the material strand (before the drawing plane) and a lower circular knife 16 (behind the drawing plane) attached below the material strand. The knife 15 is attached to a shaft 17 provided with a bearing and driven by a motor 18. The shaft 17 and the motor 18 constitute elements of the mechanism 19 of rotational motion of the knives. The mechanism 19 of the rotational motion of the knives is mounted slidably in the direction of the axis of rotation m of the circular knives and is moved by means of a linear motion mechanism 20 provided with a motor 21. For example, a mechanism comprising a guide screw rotated by a motor may be used to alter the position of the mechanism 19 of rotational motion of the circular knives 15, 16. There are many known linear motion mechanisms which may be applied here, the linear motion mechanism may be stationary mounted, while the shaft to which the circular knife is attached may be slidably mounted. The material strand 2 of the width d is cut into three partial strands a, b and c whose widths are da, db and dc, respectively. The purpose of an alteration in position of the pair 14 of circular knives 15, 16 is to alter the widths of the partial strands da, db, dc, respectively. In the embodiment shown, the material strand 2 is cut into partial strands a, b, c of which the continuous rod CR is formed, whereas it is possible to use separate feeding units to feed separate partial strands. Preferably, the apparatus is provided with a system for adjusting the position of at least one cutting element 15, 16, 35, 36 in the cutting unit 5 so as to adjust the widths of the partial strands a, b, c to determine the point of insertion of the object 9, 50, 75 being inserted (FIGS. 2, 13, 22).

Figure 4:
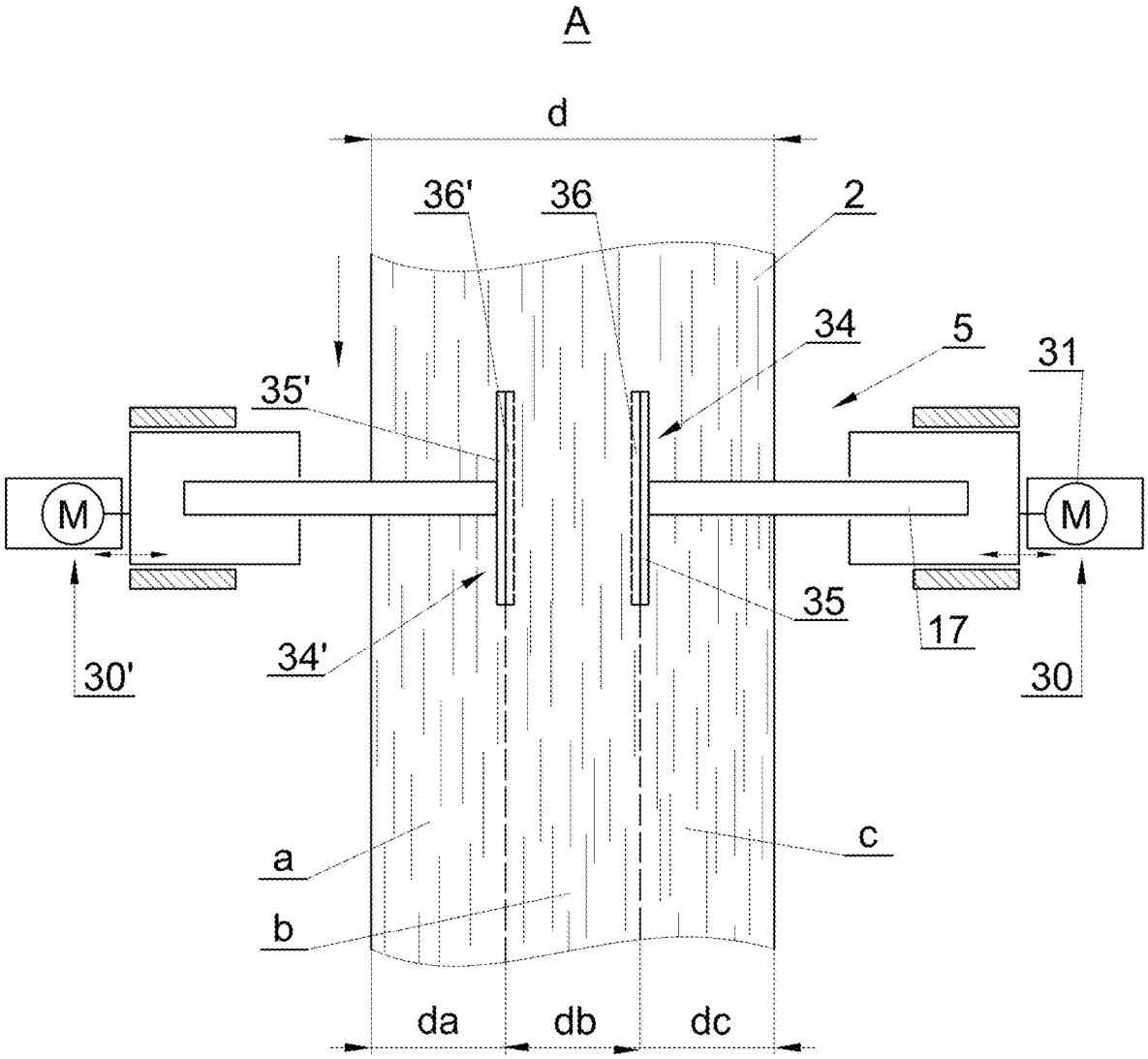

Knives in a scissors-type configuration may be used to cut the material strand. FIG. 4 shows pairs of knives 34, 34' provided with cutting edges 35, 35' and 36, 36', respectively. Besides, the cutting unit 5 is provided with at least one pair of knives 34. The cutting edges may be rectilinear, the cutting edge 35, 35' is situated above the material strand 2, whereas the cutting edge 36, 36' is situated underneath the material strand 2. With an appropriate tension of the material strand, it is possible to cut the material with single cutting edges. The position of the pairs of knives 34, 34' is adjusted by means of linear motion mechanisms 30, 30' provided with motors 31, 31'. Laser cutting units may also be used to cut the material strand. Preferably, the position of the pair of circular knives, the single cutting knife or generally the cutting elements may be adjusted in the cutting unit independently of one another.

Figure 5:
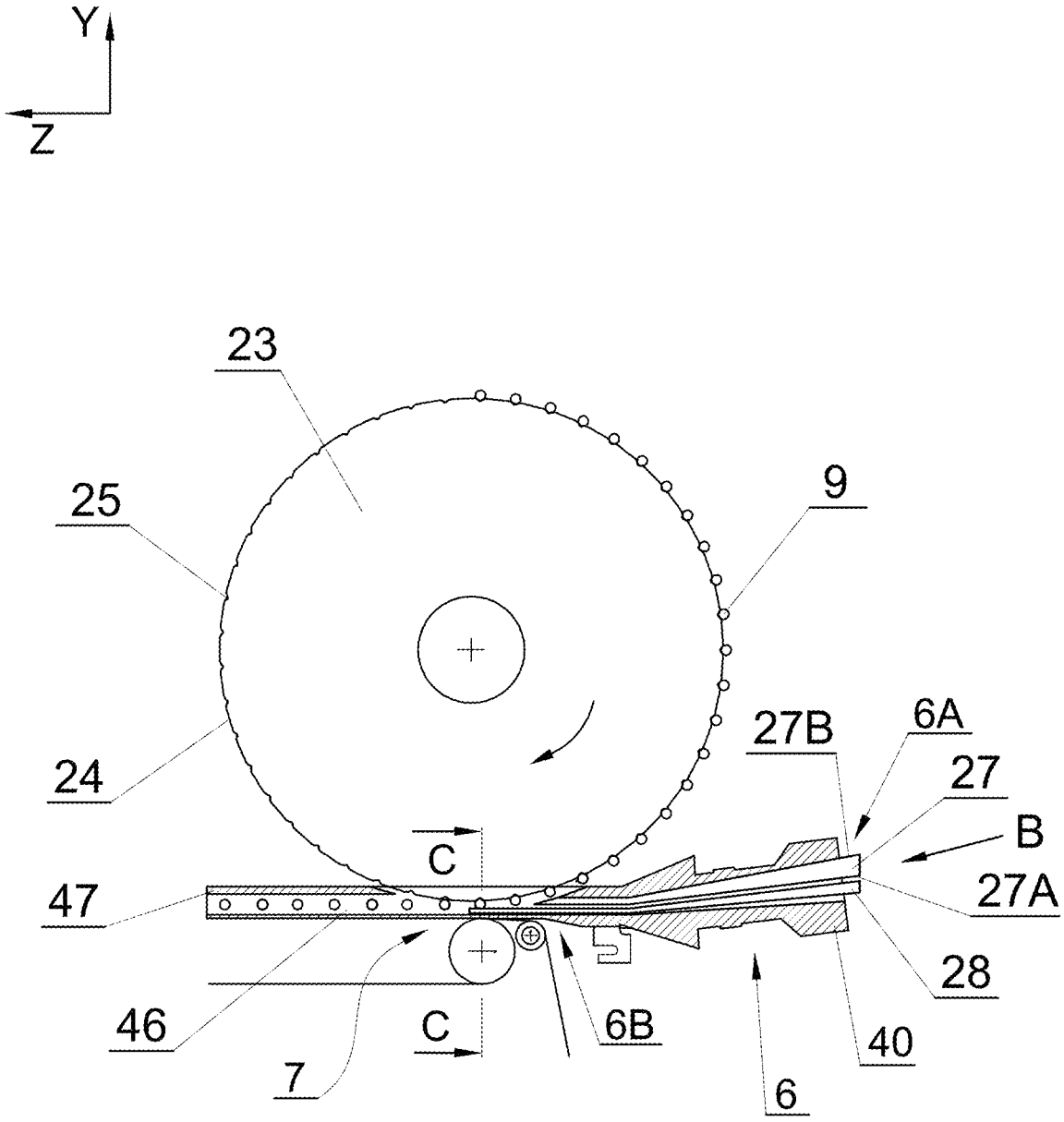
FIG. 5 shows an enlarged view of a feeding wheel of FIG. 2.
Figure 6:
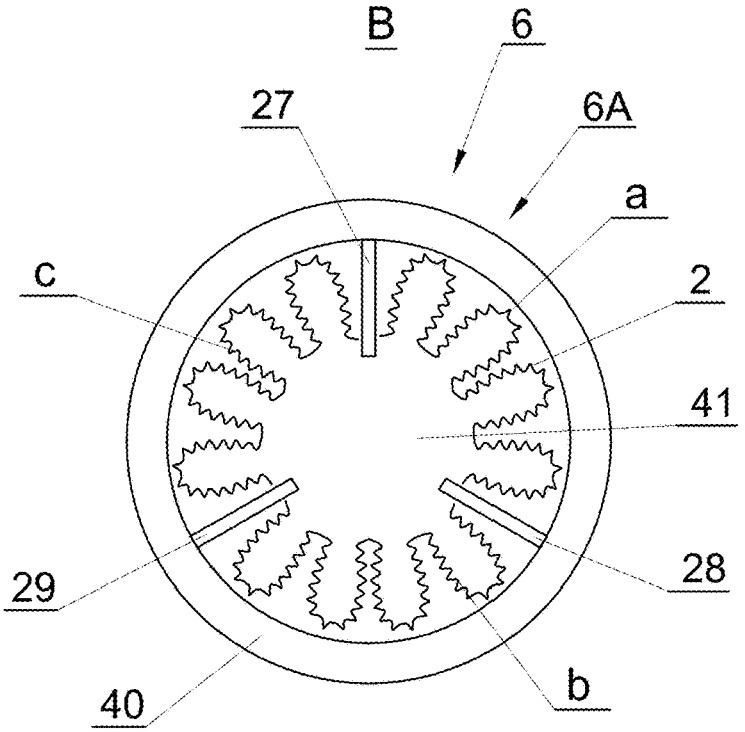
FIG. 6 shows a view of an inlet to a guiding unit in the first embodiment.
Figure 7:
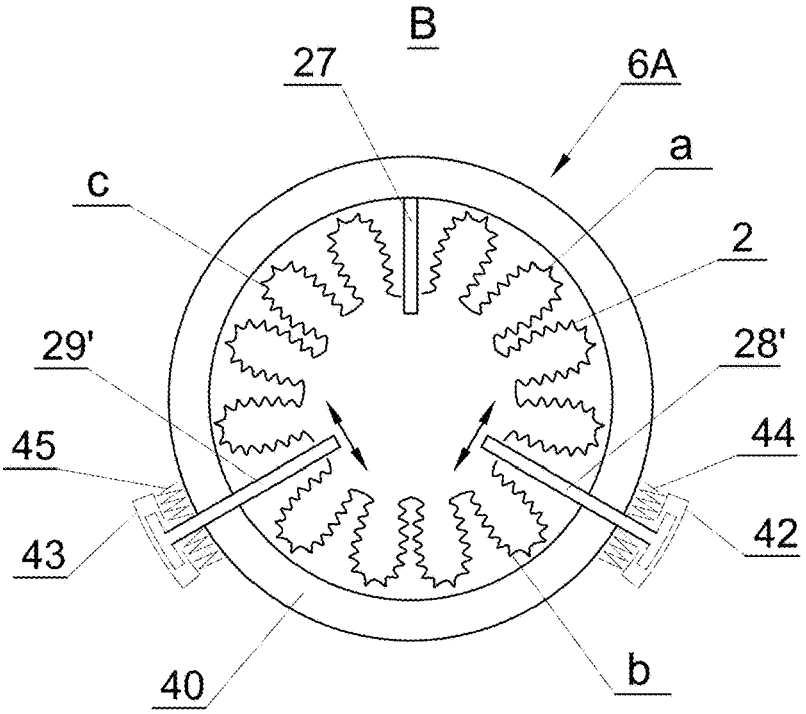
FIG. 7 shows a view of the inlet to the guiding unit in the second embodiment.

In the first embodiment of the apparatus 1 shown in FIG. 2, the feeding unit 8 for feeding of the object 9, for example the bead, has the form of a feeding wheel 23 (shown enlarged in FIG. 5) which has pockets 25 for the objects 9 disposed on its circumference 24. The abovementioned crimped partial strands a, b, c are waved transversely to the direction of movement by means of known apparatuses and enter the guiding unit 6 and the compressing unit 7, whereas the objects 9 are inserted into the compressing unit 7 by means of the feeding wheel 23 provided with the pockets 25 for the individual objects 9. The partial strands a, b, c situated next to one another change from the waved flat configuration to the waved circular configuration. FIG. 6 shows a view B of an inlet 6A of the guiding unit 6. The body of the guiding unit 6 has a shape resembling a funnel. Inside a ring 40, in a convergent channel 41, there are situated separating elements 27, 28 and 29, whereas over the length of the guiding unit 6 there is located at least one separating element 27, 28, 29 designed to separate at least two partial strands a, b, c. The upper separating element 27 runs from the inlet 6A to the outlet 6B inside the compressing unit 7 and has the shape of an oblong plate whose edges 27A and 27B are convergently situated. The lower separating elements 28 and 29 are shaped similar to the upper separating element, i.e. they are oblong and have convergent edges. As shown in FIG. 6, the separating elements may also be stationary. FIG. 7 shows the separating elements 28' and 29' attached so that their position may be adjusted, whereas the adjustment mechanism is not shown. The separating element 28' is slidably mounted in the guide 42, whereas the separating element 29' is slidably mounted in the guide 43. The position of the separating elements 28', 29' is angularly or linearly adjusted as shown with the arrows. The separating elements may be held and stabilised by means of elastic elements, preferably springs 44 and 45, which may compensate the pressures exerted by the moving partial strands a, b, c. Preferably, in the compressing unit 7, at least over a part of the compressing unit 7, there is situated at least one separating element 27, 28, 29 designed to separate at least two partial strands a, b, c. Alternatively or additionally, in the guiding unit 6 there is situated at least one separating element 27, 28, 29 designed to separate at least two partial strands a, b, c.

The separating elements 27, 28, 29 in the guiding unit 6 and/or in the compressing unit 7 is or are attached so that they may be angularly or linearly adjusted.

Figure 8:
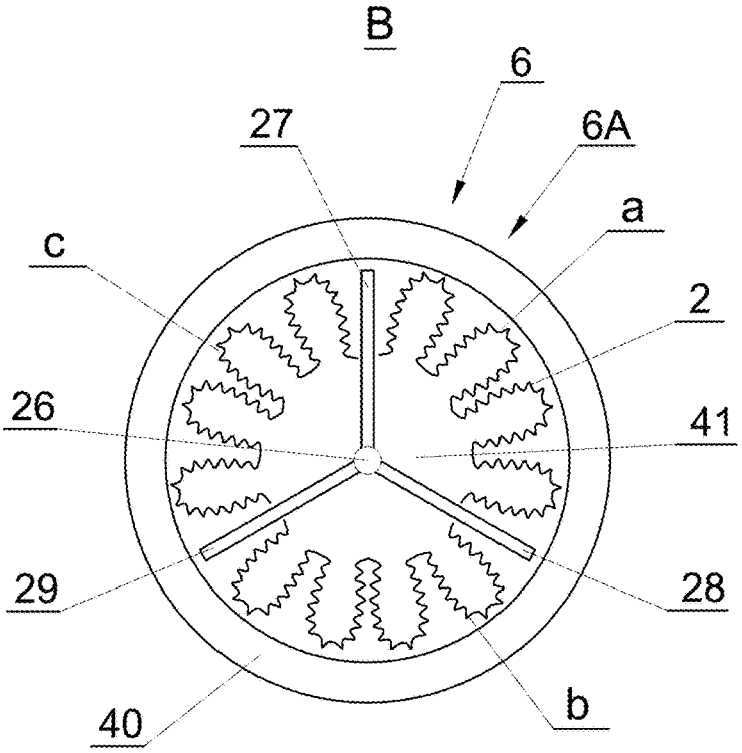
FIG. 8 shows a view of the inlet to the guiding unit in the third embodiment.

FIG. 8 shows an example of attachment of the separating elements 27, 28, 29 by means of a centrally situated element 26, for example in the form of a cylindrical rod. Such attachment of the separating elements has a predetermined system of adjustment operating transversely to the direction of movement of the partial strands a, b, c. Due to such adjustment, it is possible to change the channel cross-section for each of the partial strands a, b, c. The adjustment system is provided with elastic elements, which ensures a dynamic adaptation of the position of the separating elements to momentary variations of stresses in the partial strands being fed.

Figure 9:
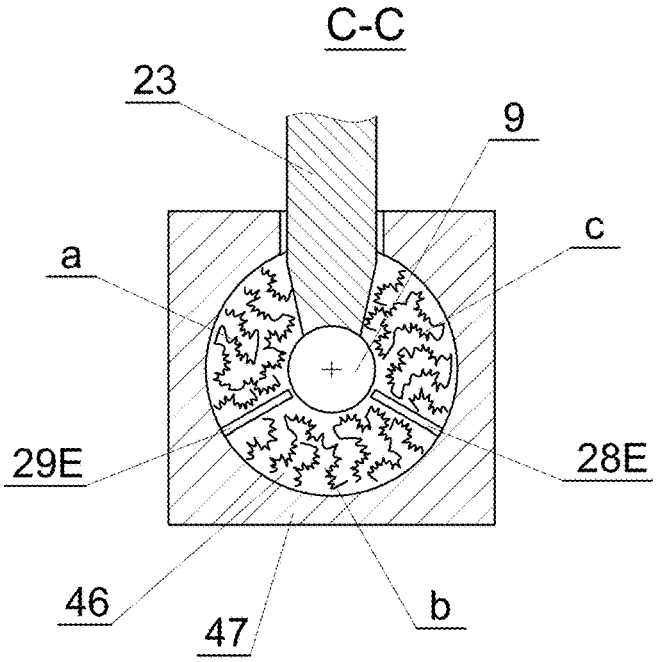
FIG. 9 shows a cross-section C-C of FIG. 5 through the feeding wheel and the guiding element.

In the cross-section C-C (FIG. 9) through the feeding wheel 23 and the channel 46 of the guiding element 47 through which the partial strands a, b, c are moved, endings 28E and 29E of the separating elements 28 and 29 are visible. The object 9 has been inserted between the partial strands a and c, pushed close to the partial strand b and placed centrally between the partial strands a, b, c which are at the final stage of compression. As shown in FIG. 5, the upper separating element 27 reaches up to the feeding wheel 23, while the lower separating elements 28 and 29 are longer, as a result of which at the moment when the object 9 takes its lowermost position its position is determined by means of the separating elements 28 and 29, and by means of the wheel 23. During a further movement, the feeding wheel 23 loses the contact with the object which is held between the partial strands a and c, while the space above the object, which was occupied by the feeding wheel 23, will be occupied by the partial strands a and c.

Figure 10A:
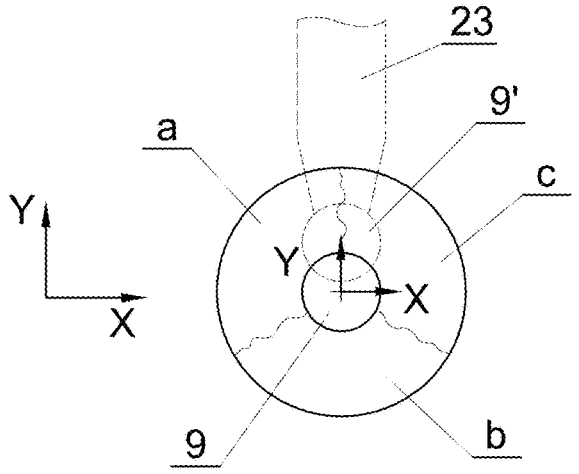
FIG. 10*a* diagrammatically shows the position of an object, centrally in the cross-section of a continuous rod.
Figure 10B:
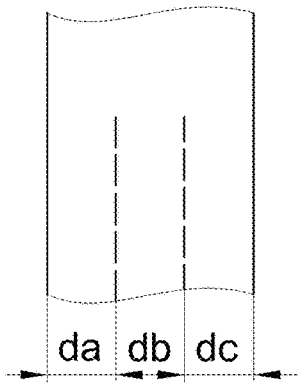
FIG. 10*b* diagrammatically shows the cutting of the material strand into three partial strands.
Figure 11A:
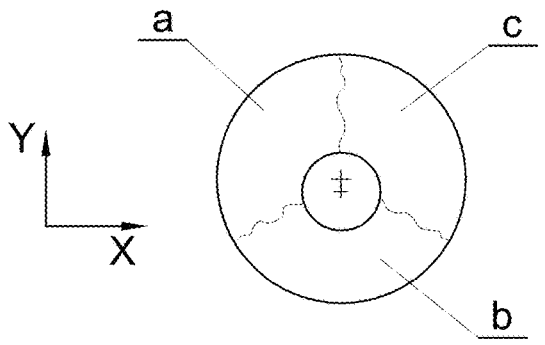
FIG. 11*a* diagrammatically shows the position of the object in the cross-section of the continuous rod, displaced in the direction Y relative to the central position.
Figure 11B:
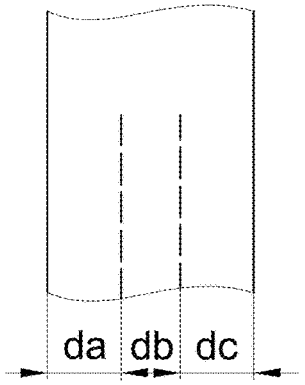
FIG. 11*b* diagrammatically shows the cutting of the material strand into unequal partial strands.
Figure 12A:
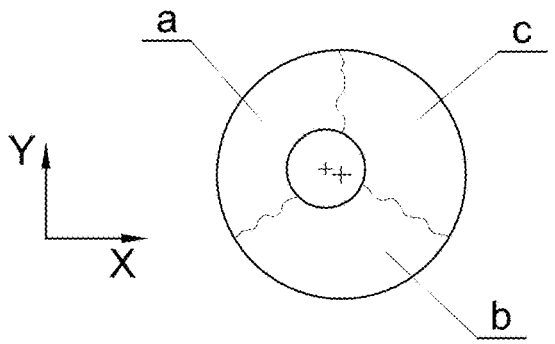
FIG. 12*a* diagrammatically shows the position of the object in the cross-section of the continuous rod, displaced in the direction Y and X relative to the central position.
Figure 12B:
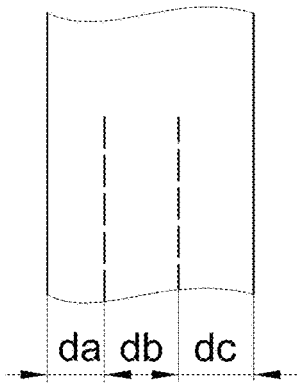
FIG. 12*b* diagrammatically shows the cutting of the material strand into unequal partial strands.

When changing the configuration from flat to circular, the middle partial strand b is being situated in the continuous rod being formed at the bottom, while the partial strands a and c are being lifted and wrapped so as to form the continuous rod CR of a circular cross-section. During the feeding, the object 9 is inserted between the partial strands a and c, and pushed close to the partial strand b. FIG. 10*a* shows the position of the object 9' in the course of inserting between the partial strands a and c held by the feeding wheel 23 and the position of the object 9 situated centrally in the cross-section of the continuous rod after inserting the object 9 to an appropriate depth, i.e. to the axis k of the continuous rod CR, the wrapping material P is not shown in the drawing. During the insertion of the object 9, there occurs a radial movement of the object 9 in a moving coordinate system connected with the axis of the continuous rod CR, i.e. in the direction of the axis Y. FIG. 10*b* shows, in simplified terms, the cutting of the material 2 strand into three equal partial strands, with the assumption that each of the partial strands a, b, c has the same density, a central location of the object 9, as shown in FIG. 10*a*, is achieved. The individual partial strands are compressed in the same way so the forces acting on the object counterbalance one another, and the object remains situated centrally. It may happen during the production that despite a correct setting of the circular knives 15, 16 the equal widths da, db, dc are not maintained, then the position of the object 9 will differ from the central position, for example as shown in FIG. 11*a*. Such position of the object 9, lowered in the vertical direction (direction Y), occurs as a result of an unequal width of the partial strands, namely the partial strands a and c are wider than the partial strand b, i.e. da>db and dc>db (FIG. 11*b*). Such non-central position is also an effect of non-homogeneity of the material used, for example resulting from the fact that the density of material w of the partial strand b is lower than the density of material w in the strands a and c. Such non-central position of the object transversely to the axis k of the continuous rod CR will be detected by means of the sensor 11, and a signal informing about the non-central position of the object will be sent to the controller S (FIG. 2) which will control the linear motion units 20, 20' so as to alter the position of the knives 15, 16 to the right, and the position of the knives 15', 16' to the left. The controller S and the linear motion units 20, 20' constitute a system for adjusting the knife for cutting material strand. FIG. 12*a* shows a situation where the object 9 is displaced in both directions X and Y, which is caused by a too small width da of the partial strand relative to the widths db and dc of the partial strands b and c, as diagrammatically shown in FIG. 12*b*.

In preferred embodiments of the invention, the unit 8 feeding the object 9 is adapted to insert the object 9 in the radial direction of the formed continuous rod CR between the partial strands a, b, c of the material strand 2.

Insertion of the object in the radial direction means the insertion of the object from the side of the outer edge of the continuous rod being formed, with a motion comprising a radial component in a coordinate system connected with the continuous rod being formed. In a coordinate system connected with the continuous rod being formed, the object being inserted in the compressing area moves in the direction determined by the radius of the continuous rod or in a resultant motion comprising a radial component.

Preferably, the insertion of the object is effected by means of the feeding wheel situated so as to insert the object between the partial strands of the material. Such structure ensures that that the object is inserted without an exposure to the occurrence of restoring forces resulting from the action of the inserting wheel on the internally entangled fibres of the strand—as it happens in conventional solutions from the prior art where for example the beads are inserted into an acetate strand being compressed.

A radial insertion may be also referred to as lateral insertion from the edge, referring to the direction of insertion, or as slot insertion when referring to the structure of the continuous rod—composed of separate partial strands which during the compression maintain slots between one another which are gradually closed in the compression area.

According to the invention, the object is safely inserted between the layers composed of compressed partial strands of the material, up to the target place in a configuration according to the preferred embodiment of the invention composed of three compressed strands, situated in the centre of the continuous rod being formed. The absence of pushing out forces and symmetrical settling the position of the object by three partial strands allows maintaining the central position of the object at a further stage of the compression process up to obtaining the formed continuous rod.

Figure 14:
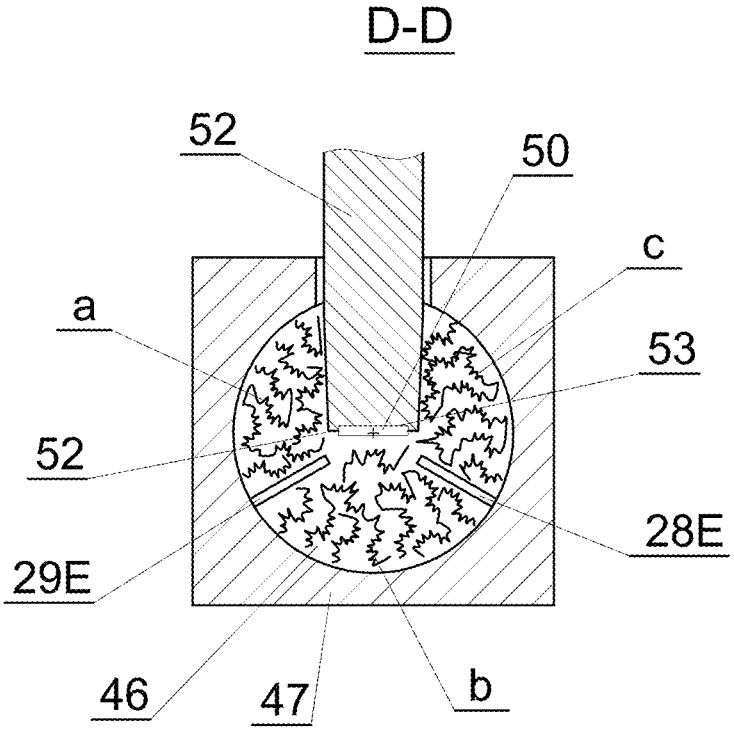
FIG. 14 shows a cross section D-D of FIG. 13 through the feeding wheel and the guiding element.

In the second embodiment, the apparatus 1' for manufacturing of rods of the continuous material strand shown in FIG. 13 is adapted to inserting a continuous object 50 into the inside of the continuous rod CR. The apparatus 1' is provided with a feeding unit 51 designed to feed the continuous object 50 in the form of a tape, for example a metal tape. The feeding unit 51 comprises a feeding wheel 52 with a groove 53 on the circumference 54 designed to feed the tape 50 from the feeding unit 51. FIG. 14 shows a cross-section D-D through the feeding wheel 52 and a guiding element 47 of FIG. 5 in the second embodiment. The partial strands a, b, c are moved through the guiding element 47. In FIG. 14, the endings 28E and 29E of the separating elements 28 and 29 are visible.

Figure 15A:
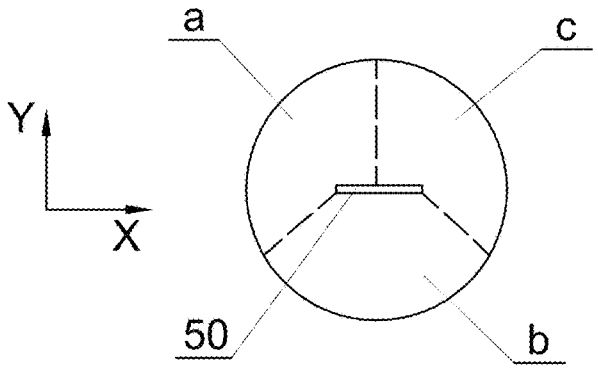
FIG. 15*a* diagrammatically shows the position of the object, centrally in the cross-section of the continuous rod.
Figure 15B:
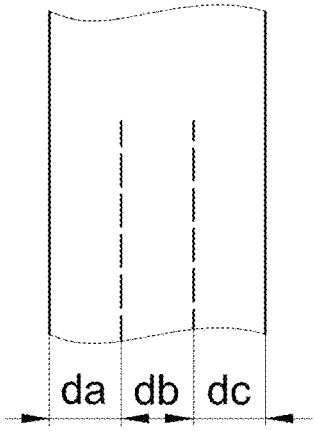
FIG. 15*b* diagrammatically shows the cutting of the material strand into three partial strands.
Figure 16A:
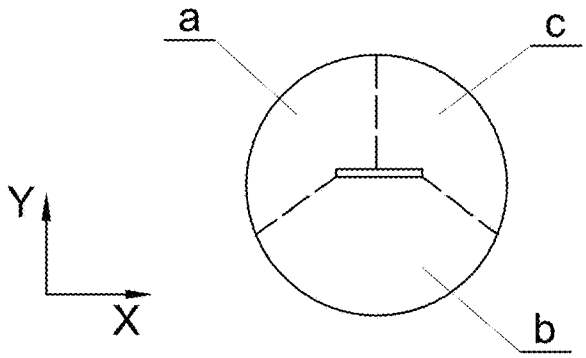
FIG. 16*a* diagrammatically shows the position of the object in the cross-section of the continuous rod, displaced in the direction Y relative to the central position.
Figure 16B:
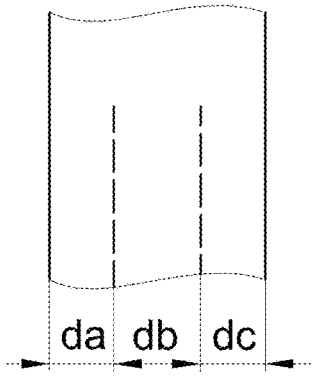
FIG. 16*b* diagrammatically shows the cutting of the material strand into unequal partial strands.
Figure 17A:
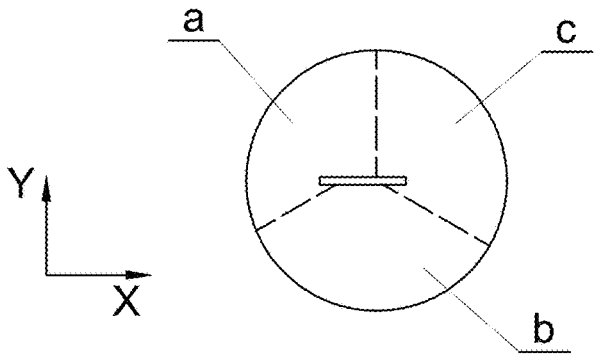
FIG. 17*a* diagrammatically shows the position of the object in the cross-section of the continuous rod, displaced in the direction Y and X relative to the central position.
Figure 17B:
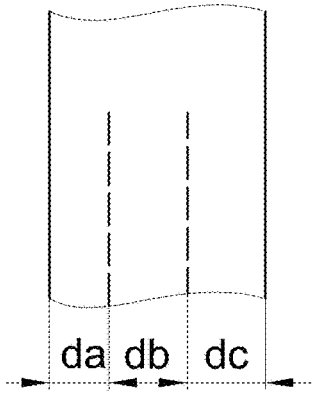
FIG. 17*b* diagrammatically shows the cutting of the material strand into unequal partial strands.

FIG. 15*a* shows, in simplified terms, a correct position of the object 50 in a cross-section through the continuous rod CR, whereas FIG. 15*b* shows the cutting of the material strand 2 into equal parts. FIG. 16*a* shows an incorrect position of the object 50 caused by a too great density of the partial strand b or a too great amount of material in the partial strand b, the object 50 is displaced in the direction Y. FIG. 16*b* respectively shows the cutting of the material strand 2 into unequal partial strands a, b, c where da=dc, db>da, db>dc. In FIG. 17*a*, the object 50 is displaced both in the direction X and in the direction Y. FIG. 17*b* diagrammatically shows the cutting of the material strand into unequal partial strands a, b, c where db>da and dc>da.

Figure 18:
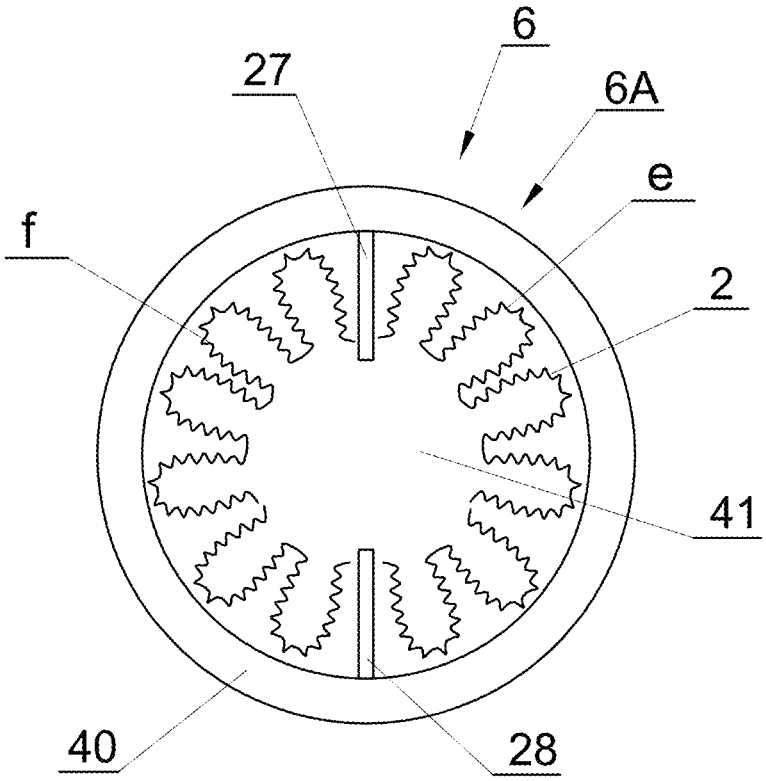
FIG. 18 shows a view of the guiding unit in the fourth embodiment.
Figure 19A:
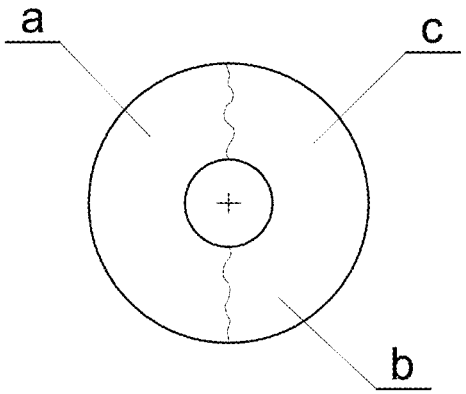
FIG. 19*a* diagrammatically shows a central location of the object in the cross-section of the continuous rod.
Figure 19B:
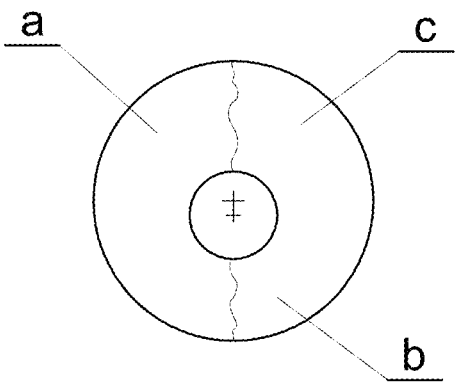
FIG. 19*b* diagrammatically shows a non-central location of the object in the cross-section of the continuous rod.

FIG. 18 shows the inlet to the guiding unit into which the parts e and f of the material strand 2 are inserted. The parts e and f are separated from each other by means of two separating elements 27 and 28 built similar to the first embodiment. FIG. 19*a* shows, in simplified terms, a correct position of the object 9, whereas FIG. 19*b* shows an incorrect position of the object 9 in the vertical direction.

Figure 20:
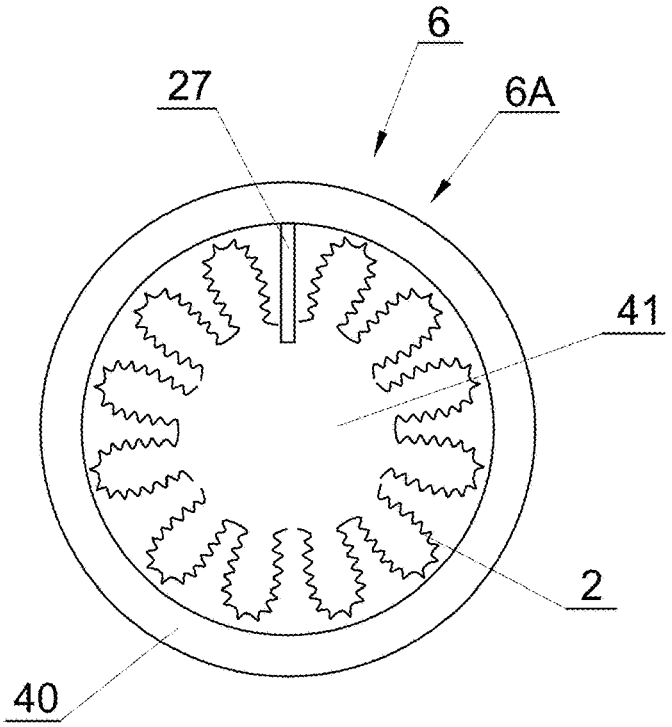
FIG. 20 shows a view of the inlet to the guiding unit in the fifth embodiment.
Figure 21:
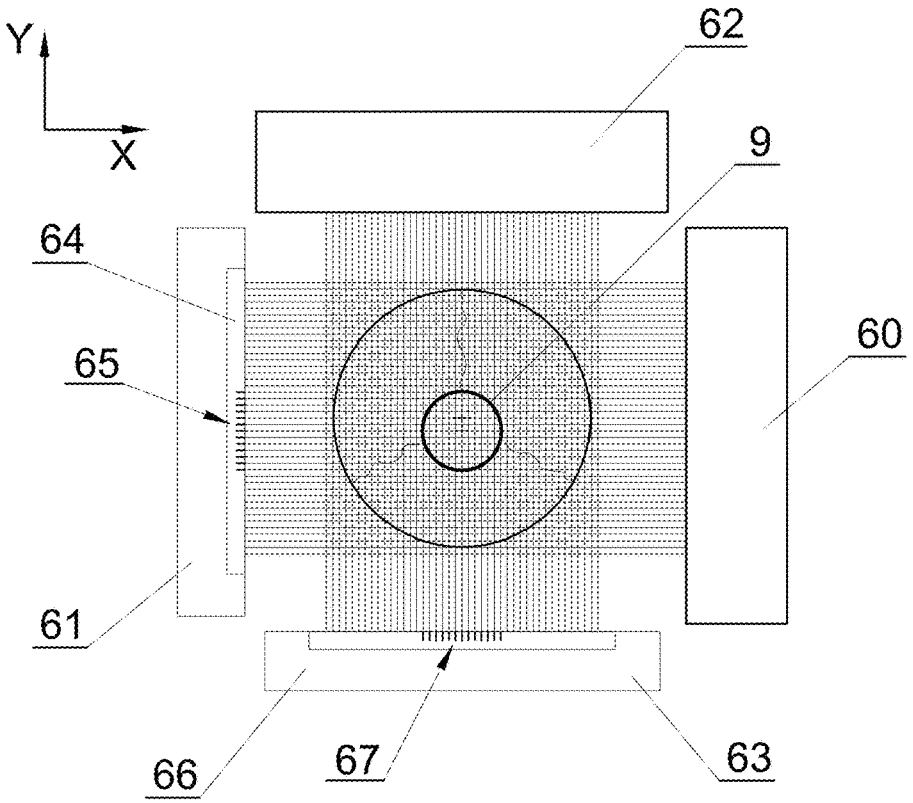
FIG. 21 shows a sensor for the detection of object location.

FIG. 20 shows the inlet to the guiding unit, whereas the material strand 2 is not divided into partial strands. The guiding unit 7 and the compressing unit are provided with one separating element 27 which is used to separate the lateral edges of the material strand 2 from each other. FIG. 21 shows a sensor 11 adapted to check the position of the object 9 inside the continuous rod CR. The sensor 11 is provided with a source of radiation 60 and a receiver 61 designed to check the position of the object in the vertical direction, i.e. in the direction Y. The receiver 61 is provided with an element 64 receiving the radiation beam, in the drawing the object 9 displaced downwards from the axis in the direction Y is shown, a fragment 65 of the element 64 will receive the radiation changed by the presence of the object 9, the signal containing the information from the element 64 will be transmitted to a controller which will give a signal to correct the position of the knives in the cutting unit 5. The sensor 11 is further provided with a source of radiation 62 and a receiver 63 designed to check the position of the object in the vertical direction, i.e. in the direction X. The receiver 63 is provided with an element 66 receiving the radiation beam, in the drawing the object 9 displaced in the direction X is shown, a fragment 67 of the element 66 will receive the radiation changed by the presence of the object 9, the signal containing the information from the element 66 will be transmitted to the controller, whereas for this signal there will be no correction of the position of the knives in the cutting unit 5. The sensor 11 may be adapted to check the position of the object in only one direction.

In the third embodiment, the apparatus 1" for manufacturing of rods of a continuous material strand shown in FIG. 22 is adapted to insert the object 75 in the form of a tube into the inside of the continuous rod CR. The apparatus 1" is provided with a feeding unit 70 comprising a storage container 71 for the rods 72 which are cut into tubes by a cutting unit 73, and it is further provided with a transferring system 74 comprising a spiral drum 76 and a feeding wheel 77 provided with pockets 78. Individual objects 75 are placed between the partial strands a, b, c in the compressing unit 7 as described in the previous embodiments, i.e. by means of the feeding wheel 77 provided with the pockets 78 for the objects 75.

The above described embodiments of the apparatus for manufacturing of rods of the continuous material strand also disclose a method for manufacturing of rods of the continuous material strand 2 wherein the material strand 2 is fed, the material strand 2 is cut lengthwise into at least two partial strands, preferably three partial strands a, b, c, the cut partial strands a, b, c are put together and the put together partial strands a, b, c are prepared for the compression, then the partial strands a, b, c are compressed by forming the continuous rod CR of the lengthwise cut partial strands a, b, c, and afterwards the object 9, 50, 75 is inserted into the inside of the continuous rod CR between the partial strands a, b, c. In the method according to the invention, the position of the object 9, 50, 75 placed inside the continuous rod CR is checked transversely to the axis of the continuous rod CR, and the position of at least one cutting element 15, 16, 35, 36 in the cutting unit 5 is adjusted so as to alter the widths of the partial strands a, b, c.

In the method according to the invention, preferably the position of the object 9, 50, 75 is checked by means of the sensor 11 and the position of at least one cutting element 15, 16, 35, 36 in the cutting unit 5 is adjusted depending on the signal from the sensor 11.

The invention claimed is:

1. An apparatus for manufacturing of rods of a continuous material strand (2) comprising a feeding unit (3) for feeding the material strand (2), a guiding unit (6) for guiding the material strand (2), a compressing unit (7) for compressing the strand and forming a continuous rod (CR) of the material strand (2), and an object feeding unit (8, 51, 70) for feeding an object (9, 50, 75) to the compressing unit (7), the feeding of the object to the compressing unit defining a point of insertion of the object being inserted, characterised by being provided with a cutting unit (5) for lengthwise cutting of the material strand (2) into at least two partial strands (a, b, c), whereas the partial strands (a, b, c) are fed through the guiding unit (6) to the compressing unit (7), the cutting unit comprising at least one cutting element, the at least one cutting element having a position, each of the at least two partial strands having a width, and by being provided with an adjustment system for adjusting the position of at least one cutting element (15, 16, 35, 36) in the cutting unit (5) so as to adjust the widths of the partial strands (a, b, c) thus determining the point of insertion of the object being inserted (9, 50, 75), wherein the compressing unit has a length, the apparatus characterised in that in the compressing unit (7), at least over a part of the length of the compressing unit (7), there is situated at least one separating element (27, 28, 29) for separating at least two partial strands (a, b, c), characterised in that a separating element (27, 28, 29) is attached by means of a spring element (44, 45).

2. The apparatus as in claim 1 wherein the compressing unit is within a region, the apparatus characterised in that the object feeding unit (51) is adapted to feed the object (50) into the region of the compressing unit (7) by means of a feeding wheel (52) provided with a guiding groove (53).

3. An apparatus for manufacturing of rods of a continuous material strand (2) comprising a feeding unit (3) for feeding the material strand (2), a guiding unit (6) for guiding the material strand (2), a compressing unit (7) for compressing the strand and forming a continuous rod (CR) of the material strand (2), and an object feeding unit (8, 51, 70) for feeding an object (9, 50, 75) to the compressing unit (7), the feeding of the object to the compressing unit defining a point of insertion of the object being inserted, characterised by being provided with a cutting unit (5) for lengthwise cutting of the material strand (2) into at least two partial strands (a, b, c), whereas the partial strands (a, b, c) are fed through the guiding unit (6) to the compressing unit (7), the cutting unit comprising at least one cutting element, the at least one cutting element having a position, each of the at least two partial strands having a width, and by being provided with an adjustment system for adjusting the position of at least one cutting element (15, 16, 35, 36) in the cutting unit (5) so as to adjust the widths of the partial strands (a, b, c) thus determining the point of insertion of the object being inserted (9, 50, 75), wherein the continuous rod has an axis, the apparatus characterised by being provided with at least one sensor (11) for checking the position of the object (9, 50, 75) placed inside the continuous rod (CR), the at least one sensor yielding a signal, transversely to the axis (k) of the continuous rod (CR), whereas the system for adjusting the position of at least one knife (15, 16, 35, 36) in the cutting unit (5) is adapted to adjust the widths of the partial strands (a, b, c) depending on the signal from the said at least one sensor (11) so as to obtain the position of the object (9, 50, 75) nearest to the axis (k) of the continuous rod (CR).

4. The apparatus as in claim 3 wherein the continuous rod has a cross-section, the cross-section defining vertical and horizontal directions, the apparatus characterised in that the sensor (11) is adapted to check the position of the object (9, 50, 75) in the cross-section of the continuous rod (CR) in the vertical or horizontal direction.

5. A method for manufacturing of rods of a continuous material strand (2) wherein the material strand (2) is fed, the material strand (2) is cut into at least two partial strands (a, b, c), the cut partial strands (a, b, c) are put together and the put-together partial strands (a, b, c) are prepared for the compression, the partial strands (a, b, c) are compressed thus forming a continuous rod (CR) of the lengthwise cut partial strands (a, b, c), and an object (9, 50, 75) is inserted into the inside of the continuous rod (CR) between the partial strands (a, b, c), characterised in that a position of the object (9, 50, 75) inserted inside the continuous rod (CR) transversely to the axis of the continuous rod (CR) is checked, and a position of at least one cutting element (15, 16, 35, 36) in a cutting unit (5) is adjusted so as to alter the widths of the partial strands (a, b, c), characterised in that the position of the object (9, 50, 75) is checked by means of a sensor (11), and the position of at least one cutting element (15, 16, 35, 36) in the cutting unit (5) is adjusted depending on the signal from the sensor (11).

6. An apparatus for manufacturing of rods of a continuous material strand (2) comprising a feeding unit (3) for feeding the material strand (2), a guiding unit (6) for guiding the material strand (2), a compressing unit (7) for compressing the strand and forming a continuous rod (CR) of the material strand (2), and an object feeding unit (8, 51, 70) for feeding an object (9, 50, 75) to the compressing unit (7), the feeding of the object to the compressing unit defining a point of insertion of the object being inserted, characterised by being provided with a cutting unit (5) for lengthwise cutting of the material strand (2) into at least two partial strands (a, b, c), whereas the partial strands (a, b, c) are fed through the guiding unit (6) to the compressing unit (7), the cutting unit comprising at least one cutting element, the at least one cutting element having a position, each of the at least two partial strands having a width, and by being provided with an adjustment system for adjusting the position of at least one cutting element (15, 16, 35, 36) in the cutting unit (5) so as to adjust the widths of the partial strands (a, b, c) thus determining the point of insertion of the object being inserted (9, 50, 75), wherein the compressing unit has a length, the apparatus characterised in that in the compressing unit (7), at least over a part of the length of the compressing unit (7), there is situated at least one separating element (27, 28, 29) for separating at least two partial strands (a, b, c), characterised in that the separating element (27, 28, 29) in the compressing unit (7) is attached so that it may be angularly or linearly adjusted.

* * * * *